US005425454A

United States Patent [19]

Przytulla et al.

[11] Patent Number: 5,425,454

[45] Date of Patent: Jun. 20, 1995

[54] STACKABLE DRUM

[75] Inventors: Dietmar Przytulla, Kerpen; Marten Burgdorf, Heimerzheim, both of Germany

[73] Assignee: Mauser-Werke GmbH, Bruehl, Germany

[21] Appl. No.: 212,676

[22] Filed: Mar. 11, 1994

Related U.S. Application Data

[63] Continuation of Ser. No. 920,562, Aug. 13, 1992, abandoned.

[30] Foreign Application Priority Data

Feb. 14, 1990 [DE] Germany ..... 40 04 578.1

[51] Int. Cl.[6] ..... B65D 7/42

[52] U.S. Cl. ..... 206/509; 206/508; 220/4.05

[58] Field of Search ..... 220/4.05, 635, 4.04; 206/509, 508

[56] References Cited

U.S. PATENT DOCUMENTS

| | | | |
|---|---|---|---|
| 3,516,571 | 6/1970 | Roper et al. | 206/508 X |
| 3,955,705 | 5/1976 | Dubois et al. | 206/509 X |
| 4,088,239 | 5/1978 | Uhlig | 220/4.05 X |
| 4,489,847 | 12/1984 | Ames | 220/634 X |
| 4,500,007 | 2/1985 | Stoll, III | 220/4.05 X |
| 4,674,648 | 6/1987 | Przytulla | 220/72 |
| 4,925,049 | 5/1990 | Przytulla | 220/72 |
| 4,928,839 | 5/1990 | Kruelskie | 206/508 |
| 5,014,873 | 5/1991 | Clemens et al. | 220/4.05 X |
| 5,018,642 | 5/1991 | Przytulla | 220/675 |

FOREIGN PATENT DOCUMENTS

| | | | |
|---|---|---|---|
| 0291695 | 11/1988 | European Pat. Off. | B65D 1/20 |
| 2585330 | 1/1987 | France . | |
| 3526921 | 7/1985 | Germany . | |
| 3708432 | 3/1987 | Germany . | |
| 8705916 | 4/1987 | Germany . | |
| 3824176 | 7/1988 | Germany . | |
| 2137158 | 10/1984 | United Kingdom | B65D 8/22 |

*Primary Examiner*—Steven M. Pollard
*Attorney, Agent, or Firm*—Pennie & Edmonds

[57] ABSTRACT

The invention concerns a large-capacity stackable drum with a substantially cylindrical sidewall and top and bottom ends. To improve the stackability in particular the long-term stackability an internal hydrostatic pressure which supports the side wall is initially produced, when stacking several drums one on top of the other, in the gas space above the content and in the contents, of the drums stacked underneath, by virtue of the elastic flexibility of the top and/or the bottom of the drum, until a reduced stacking load acting through the top rim or grip ring of the drum into the drumwall is produced or support provided through the bottom rim or grip ring.

10 Claims, 3 Drawing Sheets

STACKABLE DRUM

This is a continuation of application Ser. No. 07/920,562, filed Aug. 13, 1992, now abandoned.

The present invention relates to a stackable drum, preferably a bulk drum of thermoplastic synthetic material (for example PE polyethylene) or steel, having a substantially cylindrical outer drum wall and drum top end and drum bottom end. Adjacent at least said drum top end on the outer drum wall a circumferential handlingring is provided, at least one of either the disk-shaped flat drum top or drum bottom being connected with the outer drum wall by a ringpart conical or rounded in cross-section projecting over the drum handlingring.

Plastic bung barrels are known, the flat upper and lower drum ends of which are connected with the cylindrical outer drum wall by a diagonally conical or rounded ringpart, as for example in the German registered patent G 87 05 916. Since with such barrels, the circumferential handlingring generally takes on the additional function of rolling hoops, they extend substantially radially away from the outer drum wall; furthermore, there is a comparatively large axial projection distance from the drum bottom and top ends in an axial direction outwards and considerable spacing between the drum bottom end and drum top end and the diagonally conical ringpart of these outwardly projecting handlingrings. An axial loading force on these ringparts is, if at all, only possible to a very limited extent, since this would lead to the bending of the L-shaped rings protruding radially from the drum wall and to deformation of the outer drum wall. The handlingrings have no influence on the stacking capacity of such drums.

Figure 1:
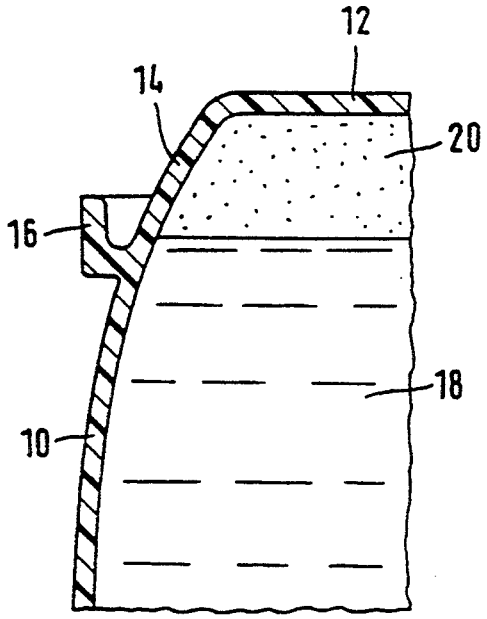
Figure 2:
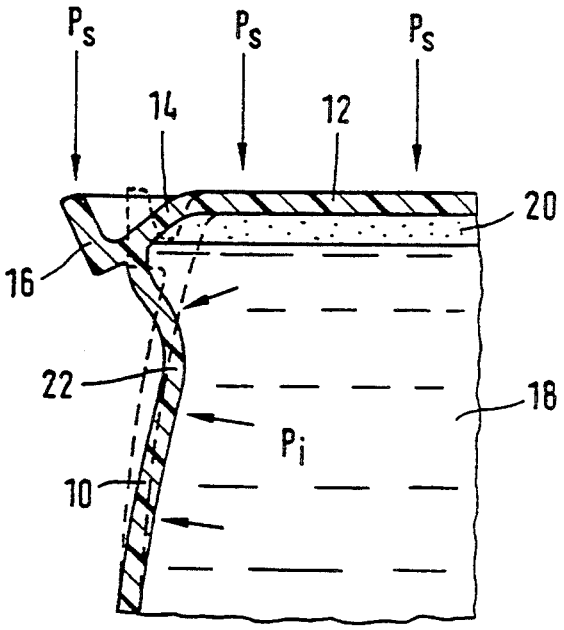

In stacking such drums, the absorption of the stacking forces takes place only following the deformation of the conical and curved formed ringparts of the flat drum top and bottom ends by means of the build-up of an internal hydrostatic pressure: the outer drum wall takes the strain here axially, not directly, and only after the deformation of the handlingring (see FIGS. 1 and 2).

Since drums are usually transported and stacked on palettes and these palettes generally do not have an even abutment surface on the underside, being comprised of two or three floor boards spaced parallel, there is normally, when stacking, no constant stacking force exerted on the top end of the drum stacked at the bottom.

Such one-sided and irregular straining can easily lead to the lower drum giving way on one side and hence increases the danger of the stacked drums tipping over on one side.

Furthermore, there are other bulk bung barrels, on which the handlingrings are formed by an axial extension of the outer drum wall and by the drum top and bottom ends being tapered, let in flush. With such drums, as for example with the customary steel drum, the absorption of the stack loading takes place solely through the rigid, stiff outer drum wall. For this reason, these drums, if made of plastic, have a relatively thick outer drum wall, which admits no elastic axial deformation or hardly any at all; an internal hydrostatic pressure is usually not built up with such drums. In the event, however, of an internal pressure build-up, the flat drum top end and flat drum bottom end are free to arch outwards respectively, without being able to take on the function of partial prop to the stacked load nor any action being effected against the stacked load. In principle, it is of no consequence here whether the drum is empty or filled and the bungs open or sealed. It follows that another disadvantage of such a drum is its correspondingly heavy tare weight and the weight of the manufacturing materials.

It is, therefore, the object of the present invention to improve the stacking properties of bulk drums and in particular the long-term stacking quality, at the same time enabling a saving in drum material and reduction in drum tare weight.

This function is fulfilled by the present invention in that the length of the upper projection distance from at least one drum top or bottom end outwardly to the appropriate handlingring amounts to one to five times the wall thickness of the outer drum wall.

This design thus makes it possible, when the drums are stacked one on top of the other, that in the bottom drum, loaded with drumfilling (e.g. liquid) and sealed so as to be gastight, in the upper gas space below the drum top end and in the drumfilling, an internal hydrostatic pressure between 0.1 and 0.3 bar, preferably some 0.16 bar, builds up definably reproducible, the drum top end or/and drum bottom end projecting outwardly, first elastically yielding, before a reduced pressure loading by stack force is transmitted into the outer drum wall and handlingring.

Due to the barrel design in the present invention, comprising adjacent the drum ends the upper drum ring or/and lower drum ring integrally connected to the outer drum wall, being substantially an axial extension of the outer drum wall and, having a flat drum top end and drum bottom end, projecting axially outwards facing the axial upper face and lower face of the lifting and transport rings, the said rings being connected by conical ring-shaped outer areas with the outer drum wall, the absorption of the stack loading takes place successfully in the vertical handlingrings formed substantially axial to the outer drum wall, the flange edge projecting radially outwards, only once an expressly defined internal pressure has built up inside the drum. Here a defined internal hydrostatic pressure is first built up and only after a radial initial tension has accumulated is the loading axially transmitted into the outer drum wall over the handlingrings, the stacking load impact being distributed over a wider peripheral section of the outer drum wall by the axial binding of the handlingrings given locally limited loading. By reason of the internal pressure prevailing, the danger of drum wall deformation is relayed to a larger axial loading. This means that such drums can take on a substantially greater stacking load and at the same time the danger of them tipping over is considerably lessened. As a result, for example, with a given estimable loading for the lower stacked drum of some 900 kg and a threefold drum stack of, for example, 220-liter drums, it is possible to reduce the thickness of the outer drum wall and hence accordingly the drum tare weight. With a steel drum, a steel plate of, for example, 0.9 mm can be used, in contrast to the steel plate hitherto applied having a wall thickness of 1.0 mm. The wall thickness of a plastic drum can for example be reduced from 3.8 mm to 3.3 mm–3.2 mm. Expediently this results in a reduction of the material weight of an empty drum from for example 9.0 kg to some 8.5 kg and a saving in the synthetic raw material.

The drums as designed in the present invention display a substantially better long-term stacking quality than other known plastic drums by reason of the additionally stabilizing internal pressure exploited. By reason of the axial effect exerted on the drum top and bottom ends and the propping function of the respective palettes, the outer drum wall only needs to bear a reduced stacking load.

Figure 3:
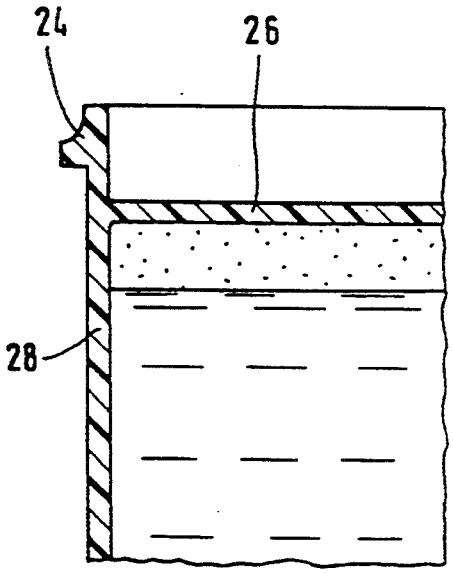
Figure 4:
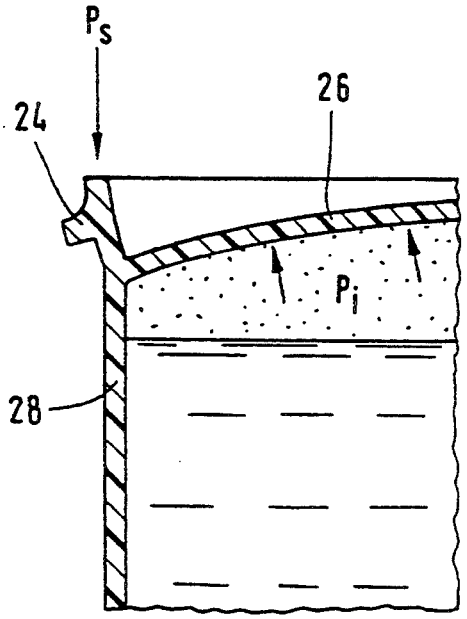
Figure 5:
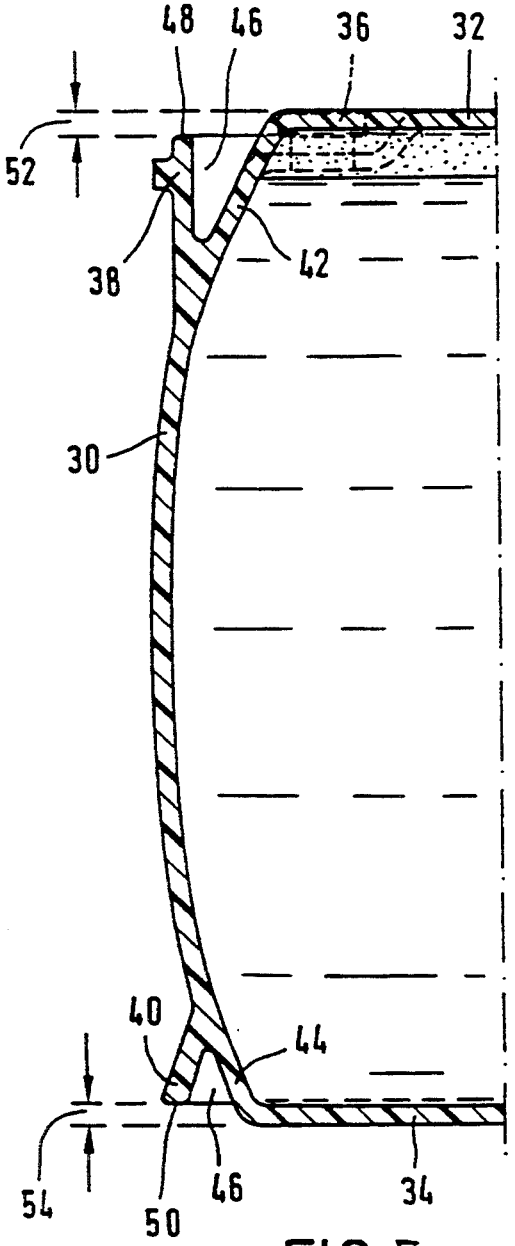
Figure 6:
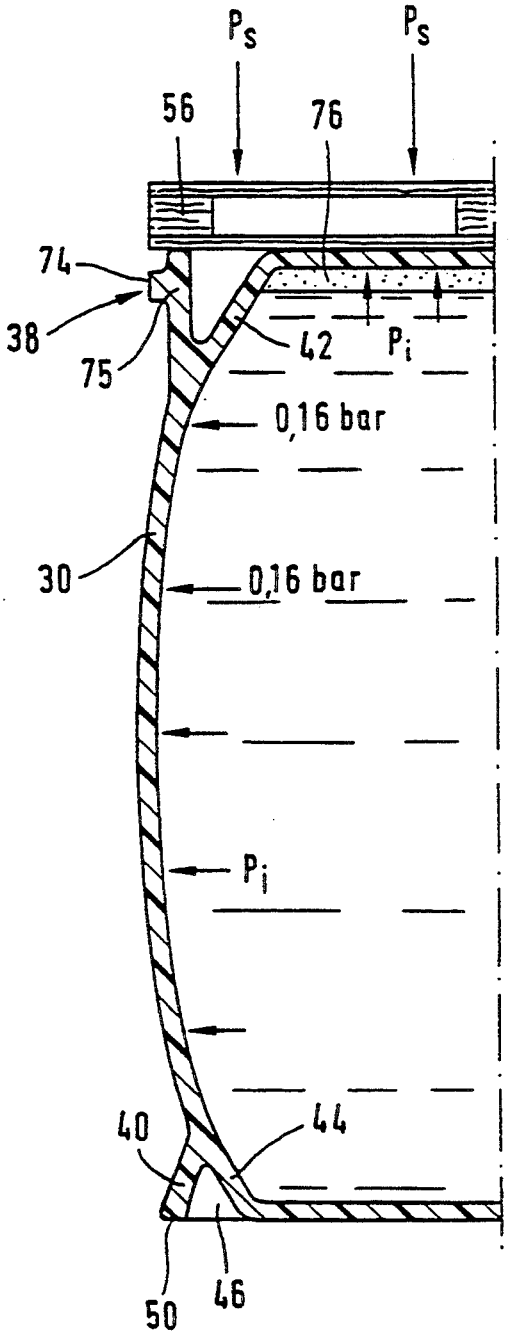
Figure 7:
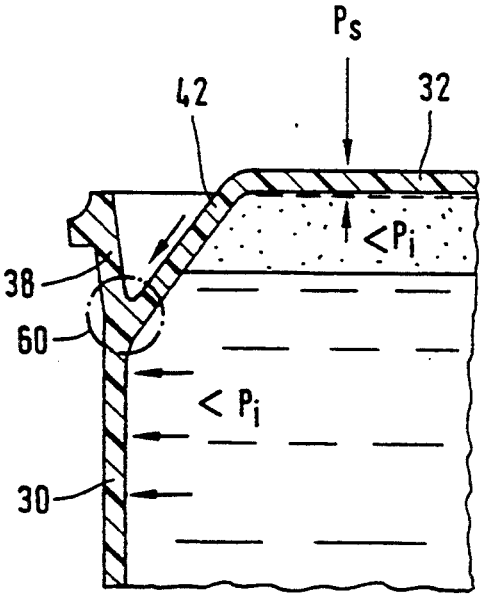
Figure 8:
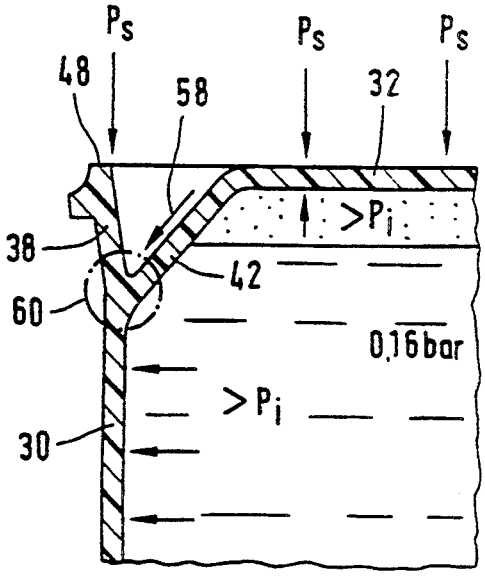
Figure 9:
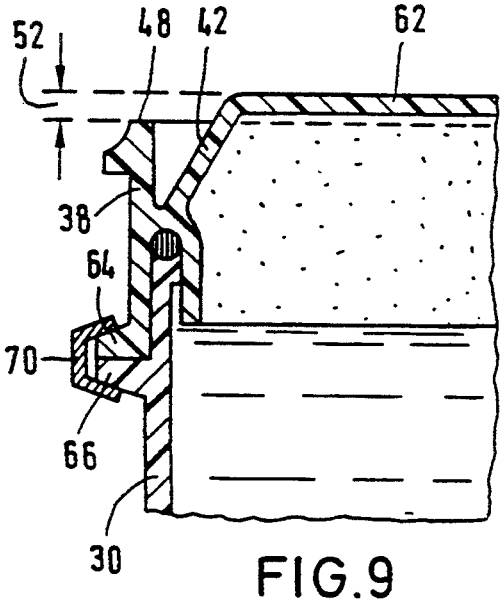
Figure 10:
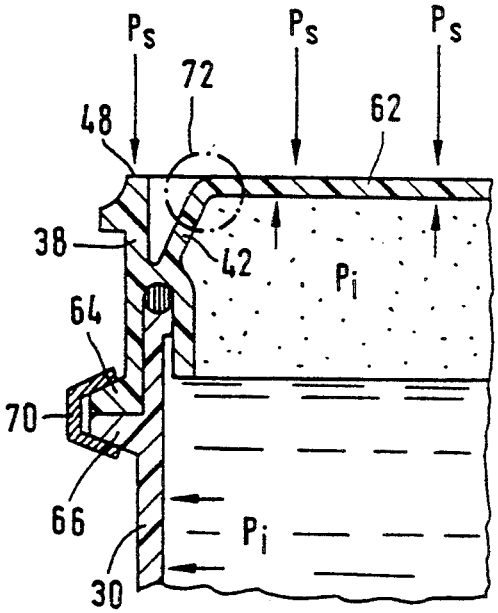

The invention is now described by way of example with reference to the accompanying drawings in which FIG. 1 is a known plastic drum with drum top end projecting well over the outer handlingring FIG. 2 is the known plastic drum represented in FIG. 1 undergoing strain as under-stacked drum FIG. 3 is another known drum with upper handlingring projecting wall over the upper handlingring FIG. 4 is the known drum represented in FIG. 3 undergoing strain as under-stacked drum FIG. 5 is a plastic bung barrel FIG. 6 is the plastic drum represented in FIG. 5 undergoing strain as under-stacked drum FIG. 7 is a section of a drum as embodied by the invention in a state of increasing strain application FIG. 8 is the drum represented in FIG. 7 in the final state of strain as under-stacked barrel FIG. 9 is another open top drum (with lid) as embodied by the invention and FIG. 10 is the open top drum with lid as represented in FIG. 9 undergoing strain as under-stacked drum FIG. 1 denotes with reference number 10 the outer drum wall of a generally well known comparatively thin-walled plastic drum, the top end 12 being connected with the outer drum wall 10 by a diagonally conical ringpart 14. In the transition portion from the conical ringpart 14 in the outer drum wall 10 a circumferential upper handlingring 16, L-shaped in cross section, is provided for lifting and transportation. The drum is filled to about the height of the upper handlingring 16 with a liquid (drumfilling), a free upper gas space 20 remaining below the drum top end 12 projecting well over the said outer upper handlingring.

FIG. 2 denotes the loading strain of this known drum and illustrates an internal pressure build-up in the free upper gas space 20 and the liquid 18 filled into the drum by the downward sinking of the drum top end 12. In normal circumstances, there is no provision for an axial straining of the upper handlingring 16. However as soon as the loading strain is stepped up and the drum top end undergoes deformation, an axial straining of the handlingring setting in—in practice this does not usually happen evenly but for example because of a narrow palette floor board mostly partially or one-sidedly—then the drum top end can not absorb axial forces or transmit them into the drum wall but bends outwardly and down, leading in this zone to early deformation 22 of the outer drum wall and hence to a greater danger of the stacked drums tipping over. Once the strain has been eased, this handlingring is no longer secure, nor can it be handled any longer.

FIG. 3 is another well known drum manufactured out of comparatively thick-walled plastic. The other upper handlingring 24 is affixed axially well over the drum top end in extension of the outer drum wall 28.

As can be seen from FIG. 4, an axial pressure loading can only be transmitted over the upper face of the handlingring and absorbed by the outer drum wall 28. With an excessive loading strain, the elastic deformation can cause the other upper handlingring 24 to expand radially and the drum body to be compressed. As a result, when internal pressure builds up, the drum top end 26 (and drum bottom end) can become protuberant outwardly without outer resistance (no propping force from stacking load). Such drums made from thick-walled plastic are expensive because they require a large amount of material and result in a heavy empty drum weight.

FIG. 5 illustrates a bung barrel as embodied by the invention, with a comparatively thin-walled substantially cylindrical plastic drum wall 30, drum top end 32 and drum bottom end 34. Formed into the edge zone of the said even flat drum top end 32 is a filling/draining bung. Adjacent the plastic drum wall 30 an upper handlingring 38 and a lower handlingring 40 are provided. Drum top end 32 and drum bottom end 34 are connected by a conical ringpart, 42, 44 with the outer drum wall. As a result behind the upper handlingring 38 and the lower handlingring 40 there is a circumferential free space 46 for engaging the catch of an appropriate drum gripper or crane hook. Particular feature of the invention embodied here is that with the invented drum, the top end and/or bottom end, 32, 34 protrudes over the upper and lower face surfaces 48, 50 of the respective upper and lower handlingrings 38, 40. With the drawing on the drum performance in FIG. 5 the upper projection distance 52 of the drum top end 32 above the upper handlingring 38 as well as the lower projection distance 54 of the drum bottom end 34 below the lower handlingring 40 is about twice as much as the wall thickness of the plastic drum wall 30.

FIG. 6 schematically demonstrates the strain put on the drum embodied by the invention by a palette 56 laid on top of the drum, exerting compression on the drum with the stack loading $P_S$. The drum ends are so designed as to project to a certain degree and as a result, a defined reproducible internal pressure of some 0.16 bar is built up within the filled and tightly sealed drum, so that only following an initial radial tension does the axial straining of the plastic drum wall 30 ensue. An advantage of this is a superimposition of axial and tangential tensile stresses and axial compressing or stacking forces, all of which are partially self-compensative.

FIG. 7 and FIG. 8 illustrate another positive effect. Once the strain starts to set in (FIG. 7), for example by stacking another drum on top of the drum, and the drum top end 32 is compressed, an elastic deformation of the upper conical lid-ringpart of the drum top end 42 beginning, an additionally stabilizing pressure force takes effect in a radial area direction—indicated by arrow 58—from the interior to the plastic drum wall 30 in the connection zone 60 between the plastic drum wall 30 and upper handlingring 38 and the upper conical ringpart of the drum top end 42. Given the greater strain, for example, of two stacked drums (FIG. 8), a considerable part of the stack loading force is transmitted axially over the upper face 48 of the upper handlingring 38 into the outer drum wall.

By reason of the internal pressure $P_i$ prevailing and the additionally stabilizing force of pressure from the upper conical ringpart of the drum top end 42—both counteracting a deformation and collapse of the drum wall into the interior—the stacking performance and in particular the long-term stacking quality of the drum as embodied by the invention are improved considerably. As a result of the internal pressure effected on the drum ends and their propping function against the palettes, the outer drum wall only needs to bear a considerably reduced pressure loading; consequently, material fatigue, ageing and diminished long-term inherent stability with loss of strength, as with customary plastic barrels, does not occur, or if at all only very much later.

Another example demonstrating the performance of a drum as embodied by the invention, is seen in the form of an open-top drum with lid (wide-necked drum) in FIG. 9 and FIG. 10. Here the upper handlingring 38 is provided with the periphery of the drum lid 62. The drum lid 62 is supported with its lower outer lidrim (flange) on a drum wall flange 66 projecting from the outer plastic drum wall 30. The upper edge of the plastic drum wall 30 engages in a U-shaped recess in the drum lid 62, in which a sealing ring 68 is provided. By means of a closure ring 70 simultaneously overlapping the outer lidrim 64 and the drum wall flange 66, the drum lid 62 can be prestressed and firmly sealed to be gas and liquid-tight on the drum opening and outer drum wall.

When unloaded, (FIG. 9) the drum top end 32 of the drum as defined by the top of the drum lid 62 comprises an upper projection distance 52 of something like three times the wall thickness of the lid and the outer drum wall above the upper face 48 of the upper handlingring 38. When loaded, (FIG. 10), the drum lid 62 is pressed inwards to the extent of the said upper projection distance, so that the internal pressure $P_i$ builds up in the drum and axial compressive forces can be transmitted from the upper handlingring 38 over the outer lid rim 64 and the drum wall flange 66 axially into the plastic drum wall 30. In the defined deformation zone 72 adjacent the even lid area, the upper conical ringpart 42 of the top end comprises a defined deformation zone, formed for example by a plurality of circumferential, annular, accordion-like grooves on the outer and inner surface of the conical ringpart 42, which improves the elasticity and yielding capacity of the drum lid in this area. Here too by reason of the internal overpressure the outer drum wall is reinforced; hence this open top drum too displays better stacking properties and improved long-term stacking quality, thanks to its particularly constructive design.

As a result of the large diameter of the contact zone for settling down the palettes, (equivalent to the diameter of the upper handlingring 38) the compression forces are distributed better into the plastic drum wall; the total deformation is also less and their side stability is greater.

Diverging from the present invention, the handlingrings, for example, could be separately manufactured as ringparts, to be slipped, shrunk, stuck or/and welded onto the outer drum wall.

Furthermore, the drum as embodied by the invention could be produced as bung barrel, in that the entire drum top end and/or drum bottom end is prefabricated with the respective handlingring as separate individual part (for example by injection moulding) and subsequently be bonded with the cylindrical outer drum wall.

The greater stacking properties, in particular the better long-term stacking quality of bulk drums with at least one circumferential handlingring adjacent the appropriate drum end on the outer drum wall and at least one drum end protruding over the drum handlingring in an axial outward direction, has been functionally achieved in that when the drums are stacked, in the lower gastight sealed drums in the remaining free gas space and in the drumfilling and liquid an internal hydrostatic pressure of between 0.1 and 0.3 bar, preferably of some 0.16 bar, is built up, the top drum end or/and bottom end first yielding in their elasticity, before the stack loading is vertically transmitted over the outer drum wall and handlingring into the plastic drum wall, hence giving better stacking properties, particularly long-term stacking quality. Given only locally limited loading on the circumferential handlingring, which is formed in axial extension of the drum wall, the stacking load incurred is distributed expediently.

REFERENCE LIST

10 outer drum (barrel) wall
12 drum top end
14 conical ringpart of top (12) end
16 upper handlingring (L-ring) for lifting and transportation
18 liquid (drumfilling)
20 free up per gas space (volume)
22 deformation
24 other upper handlingring
26 drum top end
28 outer drum wall
30 plastic drum wall
32 drum top end
34 drum bottom end
36 filling/draining (emptying) bung
38 upper handlingring
40 lower handlingring (rolling ring)
42 upper conical ringpart of drum top end
44 lower conical ringpart of drum bottom end
46 free space for handling device (drum gripper)
48 upper face 38
50 lower face 40
52 upper projection distance 32/48
54 lower projection distance 34/50
56 palette
58 stack loading force direction (arrow)
50 connection zone 42/30/38
62 drum lid
64 outer lid rim (flange)
66 drum wall flange (rim)
68 sealing ring
70 closure ring (metal)
72 defined deformation zone
74 edge of flange (rim) 38
75 ringpart 38
76 gas space (gas volume)
$P_s$ pressure loading by stack force
$P_i$ internal pressure (hydrostatic)

We claim:

1. A bulk stackable drum comprising a substantially cylindrical drum wall (30) and disk-shaped drum top end and drum bottom end (32, 34), said drum having a longitudinal axis extending between said top and bottom ends (32, 34) and having adjacent at least the drum top end (32) a circumferential handling ring (38), said disk-shaped drum top end (32) being connected with the drum wall by an elastically deformable conical ringpart (42), extending conically between the drum wall and drum end; characterized in that the upper handling ring (38) is formed by a ringpart (75) running axially in extension of the drum wall (30) and parallel to said longitudinal axis to define a between an interior surface of the ringpart (75) of the upper handling ring (38) and the conical ringpart (42) of the drum end (32); and said top drum end (32) projects axially beyond the handling ring (38) by a projection distance (52) equal to one to five times the wall thickness of the drum wall (30) or the drum top and bottom ends (32, 34), said conically extending ringpart (42) of the drum top end (32) being upon stack loading elastically so deformable that in the drum interior a supportive hydrostatic pressure of between 0.1 and 0.3 bar, preferably approximately 0.16 bar, is first built up, before the stack loading can be transmitted into the upper handling ring (38) and into the cylindrical drum wall (30).

2. A drum as claimed in claim 1 characterized in that the ringpart (42) at the drum top end (2) is elastically deformable, the top end (2) projects axially beyond the upper handling ring (38), and the drum bottom end (34) is disposed flush with the lower handling ring (40).

3. A drum as claimed in claim 1 characterized in that the upper projection distance (52) of the drum top end (32) above the upper handling ring (38) amounts to approximately three to four times the wall thickness of the drum wall (30) and the drum top end (32).

4. Drum as claimed in claim 1 characterized in that the upper projection distance (52) of the drum top end (32) above the upper handling ring (38) amounts approximately to three times the drum wall thickness and the lower projection distance of the drum bottom end (34) below the lower handling ring (40) amounts to one to two times the thickness of the drum wall (30).

5. Drum as claimed in claim 1 characterized in that the conical ringpart (42, 44) is formed as an elastically deformable deformation zone with circumferential annular accordion-like grooves on outer and inner surfaces of the conical ringpart (42).

6. Drum as claimed in any one of the previous claims 1 to 6 characterized in that the drum top edge (32) includes a filling/draining bung (36) having an upper edge located no higher than flush with the outer surface of the drum top end (32).

7. Process to augment the stacking properties, in particular the long-term stacking quality of gastight sealed bulk drums having a top drum end and a bottom drum end and filled with liquid to define a gas space between the level of the liquid and the top drum end, said drum further having at least one circumferential handling ring adjacent one drum end on an outer drum wall, at least one drum end projecting axially beyond the drum handling ring characterized in that when the drums are stacked on top of each other at least the top drum end (32) in the lower gastight sealed drum first yields elastically to create an internal hydrostatic pressure in the drum interior between 0.1 and 0.3 bar preferably some 0.16 bar before a vertical stack loading can be transmitted over the top drum end (32) and upper handling ring (38) and into the drum wall (30), with only locally limited loading on the circumferential handling ring (38, 40) formed axially as an extension of the drum wall (30) to distribute the incurred stack load over a larger periphery of the drum wall (30) and achieve better stacking capacities, in particular improved long-term stacking quality.

8. A bulk stackable drum comprising a substantially cylindrical drum wall (30) and disk-shaped drum top end and drum bottom end (32, 34), said drum having a longitudinal axis extending between said top and bottom ends (32, 34) and having adjacent at least the drum top end (32) on the cylindrical drum wall (30) a circumferential handling ring (38), at least the top drum end (32) of the disk-shaped drum ends (32, 34) being connected with the drum wall by an elastically deformable conical ringpart (42, 44), extending conically between the drum wall and drum end; characterized in that the upper handling ring (38) is formed by a ringpart (75) running axially in extension of the drum wall (30) and parallel to said longitudinal axis to define a free wedge-shaped space between an interior surface of the ringpart (75) of the upper handling ring (38) and the conical ringpart (42) of the drum end (32); and at least the top drum end (32) projects axially beyond the handling ring (38) by a projection distance (52) equal to one to five times the wall thickness of the drum wall (30) or the drum top and bottom ends (32, 34), at least the conically extending ringpart (42) of the drum top end (32) is elastically deformable whereby upon stack loading, said conically extending ringpart deforms to create in the drum interior a supportive hydrostatic pressure of between 0.1 and 0.3 bar, preferably approx. 0.16 bar, before the stack loading can be transmitted into the handling ring (38) and into the cylindrical drum wall (30).

9. A bulk stackable drum comprising a substantially cylindrical drum wall (30) and disk-shaped drum top end and drum bottom end (32, 34), said drum having a longitudinal axis extending between said top and bottom ends (32, 34) and having adjacent at least the drum top end (32) on the cylindrical drum wall (30) a circumferential handling ring (38), said disk-shaped drum top end (32) being connected with the drum wall by an elastically deformable conical ringpart (42), extending conically between the drum wall and drum end; characterized in that the upper handling ring (38) is formed by a ringpart (75) having a normal unloaded position running substantially axially as an extension of the drum wall (30) and in axial alignment therewith and extending in a substantially parallel direction to said longitudinal axis to define a free wedge-shaped space between an interior surface of the ringpart (75) of the upper handling ring (38) and the conical ringpart (42) of the drum end (32); said ringpart (75) extending in said substantially parallel direction to the extent necessary whereby upon downward loading of said drum end (32) and said ringpart (75) in the direction of said longitudinal axis, said loading is transferred downwardly into said drum wall (30) without movement of said ringpart (75) radially outwardly of said drum wall (30); and said top drum end (32) projects axially beyond the handling ring (38) by a projection distance (52) equal to one to five times the wall thickness of the drum wall (30) or the drum top and bottom ends (32, 34), said conically extending ringpart (42) of the drum top end (32) being upon stack loading elastically so deformable that in the drum interior a supportive hydrostatic pressure of between 0.1 and 0.3 bar is first built up, before the stack loading can be transmitted into the upper handling ring (38) and ringpart (75) and into the drum wall (30).

10. A drum as claimed in claim 1 characterized in that the drum is an open top drum having an open upper end with a separate drum lid (62) supported on said upper end; and said drum top end (32), said conical ringpart (42) and said upper handling ring (38) are included in said separate drum lid (62).

* * * * *